US009624677B2

(12) United States Patent
Wright

(10) Patent No.: US 9,624,677 B2
(45) Date of Patent: Apr. 18, 2017

(54) JOINT DEVICES, SYSTEMS, AND METHODS FOR EXTERIOR FLOORING

(75) Inventor: Thomas Scott Wright, Holly Springs, NC (US)

(73) Assignee: PERGO (EUROPE) AB, Trelleborg (SE)

( * ) Notice: Subject to any disclaimer, the term of this patent is extended or adjusted under 35 U.S.C. 154(b) by 688 days.

(21) Appl. No.: 13/542,275

(22) Filed: Jul. 5, 2012

(65) Prior Publication Data

US 2014/0007525 A1 Jan. 9, 2014

(51) Int. Cl.

| | |
|---|---|
| ***E04F 15/02*** | (2006.01) |
| ***E04F 15/04*** | (2006.01) |
| *E04F 17/00* | (2006.01) |

(52) U.S. Cl.

CPC ..... *E04F 15/04* (2013.01); *E04F 15/02044* (2013.01); *E04F 15/02183* (2013.01); *E04F 17/00* (2013.01); *E04F 2015/02122* (2013.01); *E04F 2201/05* (2013.01)

(58) Field of Classification Search

USPC ... 52/582.1, 586.1, 586.2, 393, 395, 396.04, 52/396.05, 396.07, 396.1; 404/47

See application file for complete search history.

(56) References Cited

U.S. PATENT DOCUMENTS

| | | | | |
|---|---|---|---|---|
| 4,566,235 | A | 1/1986 | Groll | |
| 4,599,841 | A * | 7/1986 | Haid | 52/396.04 |
| 5,335,473 | A | 8/1994 | Chase | |
| 5,381,638 | A | 1/1995 | Andersson | |
| 5,694,730 | A * | 12/1997 | Del Rincon et al. | 52/586.1 |
| 6,248,342 | B1 * | 6/2001 | Trogolo et al. | 424/404 |
| 6,336,300 | B1 | 1/2002 | Babucke | |
| 6,363,677 | B1 * | 4/2002 | Chen et al. | 52/586.1 |
| 6,484,467 | B2 * | 11/2002 | Crout | 52/483.1 |
| 6,694,691 | B2 | 2/2004 | Ku | |
| 6,729,091 | B1 * | 5/2004 | Martensson | 52/391 |
| 6,761,008 | B2 * | 7/2004 | Chen et al. | 52/586.1 |
| 7,409,803 | B2 * | 8/2008 | Grohman | 52/489.1 |
| 7,793,483 | B2 | 9/2010 | Stanchfield | |
| 8,919,068 | B2 | 12/2014 | Wright et al. | |
| 2005/0194752 | A1 * | 9/2005 | Klosowski et al. | 277/650 |
| 2007/0028547 | A1 * | 2/2007 | Grafenauer et al. | 52/586.1 |

(Continued)

FOREIGN PATENT DOCUMENTS

| | | |
|---|---|---|
| DE | 101 62 275 | 2/2003 |
| DE | 20 2004 015 283.5 | 12/2004 |
| WO | WO 2012/168446 | 12/2012 |

OTHER PUBLICATIONS

U.S. Appl. No. 13/781,088, dated Feb. 28, 2013.

(Continued)

*Primary Examiner* — Joshua J Michener
*Assistant Examiner* — Kyle Walraed-Sullivan
(74) *Attorney, Agent, or Firm* — Jenkins, Wilson, Taylor & Hunt, P.A.

(57) ABSTRACT

Novel joint devices and systems are disclosed. In one aspect, a joint member for an exterior floor covering can include a body portion, at least one tongue portion extending from the body portion, and at least one opening extending through the body portion. The opening can be configured to pass a liquid directly from an upper surface of the exterior floor covering through the body portion of the joint member.

23 Claims, 5 Drawing Sheets

(56) References Cited

U.S. PATENT DOCUMENTS

| | | | |
|---|---|---|---|
| 2007/0094985 | A1 | 5/2007 | Grafenauer |
| 2007/0196614 | A1 | 8/2007 | Kellner |
| 2009/0313915 | A1 | 12/2009 | Kellner |

OTHER PUBLICATIONS

Restriction Requirement for U.S. Appl. No. 13/781,088 dated Dec. 26, 2013.
Non-Final Office Action for U.S. Appl. No. 13/781,088 dated Feb. 12, 2014.

* cited by examiner

JOINT DEVICES, SYSTEMS, AND METHODS FOR EXTERIOR FLOORING

TECHNICAL FIELD

The subject matter disclosed herein relates generally to novel joint devices, systems, and methods. More particularly, the subject matter disclosed herein relates to novel devices, systems, and methods for providing exterior flooring that can be installed over existing exterior surfaces, such as surfaces of an outdoor deck.

BACKGROUND

Easy to assemble, or "do it yourself" (DIY) floor panels have increased in popularity for use as replacements for interior parquet floors, linoleum sheet floors, and wall-to-wall carpets. Such floor panels offer consumers durable and aesthetically pleasing products at affordable price points. In conventional systems, opposing first and second edges of a floor panel are provided with a groove and a tongue, respectively, such that adjacent floor panels can directly engage and lock together. For example, a tongue of a first floor panel can engage and lock directly with a groove of a second panel. All four edges of a conventional floor panel can lock directly with one or more adjacent panels forming joints directly therebetween.

Conventional floor panels, systems, and methods have several disadvantages rendering them unsuitable for outdoor use and are therefore, unsuitable for use in exterior floor covering applications. For example, one disadvantage of conventional floor panels, systems, and methods is that the floor panels are pulled together tight on all four sides forming substantially gap-free joints therebetween. There is no effective manner in which water from rain, melted snow, ice, or moisture and/or liquid from other outdoor weather conditions, can leave the surface of the floor panels or effectively penetrate the joint between adjacent panels. Thus, when used in an outdoor environment, water will pool on the surface of conventional floor panels which can create an undesirable surface. Large quantities of moisture and/or liquids resulting from weather or outdoor environmental conditions could also accumulate on surfaces of floor panels and cause adverse effects such as swelling and/or buckling of the floor panels. Accordingly, a need remains for devices, systems, and methods for establishing suitable floor coverings adapted for exterior or outdoor use.

One proposed method of using conventional floors panels exterior to the home (e.g., outdoors) includes installing the floor panels at a sloped angle or incline, thereby allowing water to run off the surface at an angle. This method is impractical as it would require installing floor panels over an existing outdoor structure (e.g., a wood deck) where a sloped surface is not needed. In addition, this option requires significant and costly modifications to the existing structure being covered by the floor panels. This method also presents a further challenge and is disadvantaged as outermost floor panels can be installed with a perimeter transition or end molding, which would effectively dam the water and prevent it from running off of the sloped surface. As an alternative to a floor covering, conventional wooden decks or outdoor floors can be replaced with new wood or a wood plastic composite structure. However, this option is not DIY and is expensive. To date, an effective joint device for allowing water to pass through a floor covering is lacking in the art.

Despite the availability of various devices, systems, and methods in the marketplace, a need remains for joint devices, systems, and methods for providing exterior floor coverings. A need exists for providing a joint between edges of floor panels such that water can efficiently pass therebetween for preventing pools of water from accumulating on the surface of provided floor coverings.

SUMMARY

In accordance with this disclosure, joint devices, systems, and methods for exterior flooring are provided and described herein. Joint devices, systems, and methods described herein can provide improved and efficient draining capabilities from surfaces of a floor covering and can be well suited for a variety of exterior/outdoor applications such as an exterior floor covering installed over an existing real wood or non-wood deck, or over portions of an existing deck such as what can be done with an exterior area rug. It is, therefore, an object of the present disclosure to provide joint devices, systems, and methods for exterior flooring which offer beauty, ease of installation, and an alternative to refinishing an existing outdoor surface, for example, by washing, sanding, and staining an aged wood deck.

These and other objects of the present disclosure as can become apparent from the disclosure herein are achieved, at least in whole or in part, by the subject matter disclosed herein.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1:
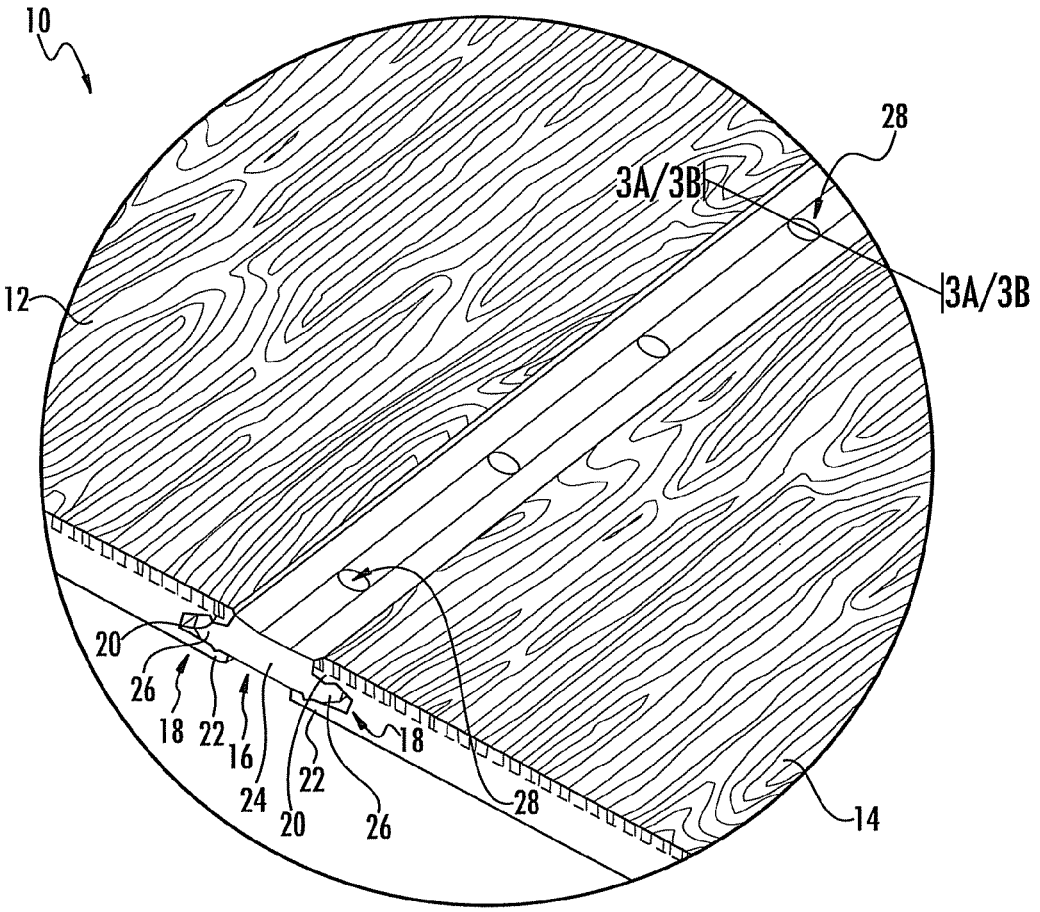
FIG. 1 is a top perspective view of a joint device and system of floor panels for an exterior floor covering according to the disclosure herein.

The subject matter disclosed herein is directed to joint devices, systems, and methods for exterior floor coverings including, for example, a floor covering suitable for outdoor use and installation over existing surfaces such as patio and/or real wood or non-wood type deck surfaces. Novel joint devices or members provided herein can be disposed between adjacent floor panels and can be adapted to pass water or moisture between the adjacent panels. Notably, the joint device or member can extend in length/width to uniformly fill a gap between adjacent panels while allowing water to pass through, as well as serving as a connector for long sides of adjacent panels. In one embodiment, the joint member can be disposed longitudinally between adjacent first and second rectangular floor panels. At least a portion of a joint member can be positioned in a portion of a groove of one or more floor panels. The joint can advantageously allow water to drain from an upper surface of the panel members towards a lower surface of the panel members which rests on a preexisting exterior structure, such as a deck or patio surface. Reference will be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the present subject matter are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion are described herein as being formed "directly on" the structure or portion. Similarly, it will be understood that when an element is referred to as being "connected", "attached", or "coupled" to another element, it can be directly connected, attached, or coupled to the other element, or intervening elements may be present. In contrast, when an element is referred to as being "directly connected", "directly attached", or "directly coupled" to another element, no intervening elements are present.

Furthermore, relative terms such as "on", "above", "upper", "top", "lower", or "bottom" are used herein to describe one structure's or portion's relationship to another structure or portion as illustrated in the figures. It will be understood that relative terms such as "on", "above", "upper", "top", "lower" or "bottom" are intended to encompass different orientations of the component in addition to the orientation depicted in the figures. For example, if a component or feature in the figures is turned over, structure or portion described as "above" other structures or portions would now be oriented "below" the other structures or portions. Likewise, if components in the figures are rotated along an axis, structure or portion described as "above", other structures or portions would be oriented "next to" or "left of" the other structures or portions. Like numbers refer to like elements throughout.

Unless the absence of one or more elements is specifically recited, the terms "comprising", including", and "having" as used herein should be interpreted as open-ended terms that do not preclude the presence of one or more elements. As used herein the terms "weatherproof" and "waterproof" are synonymous terms used interchangeably to describe materials that are inherently, or have been treated to become, resistant to penetration by water and wetting. Weatherproof and waterproof materials can comprise natural or synthetic materials that can include, be laminated to, and/or be coated with a waterproofing material such as plastic, resin, rubber, polyvinyl chloride (PVC), polyurethane (PU), silicone elastomer, fluoropolymers, wax, or any other suitable material. Weatherproof materials can further include a metal which has been extruded, anodized, and/or plated.

FIGS. 1 through 5 illustrate embodiments of joint devices, systems, and methods according to the present subject matter as disclosed and described herein. FIG. 1 is a top perspective view of a system 10 for an exterior floor covering. System 10 can comprise at least a first floor panel 12, a second floor panel 14, and a joint disposed therebetween. The joint can be adapted to discharge water from surfaces of the first and second floor panels 12 and 14, respectively, and can be configured to effectively drain water between the panels. First and second floor panels 12 and 14 and the joint can comprise weatherproof materials suitable for outdoor use. In one embodiment, the joint between adjacent panels can comprise a discrete joint device or member that can be separate and distinct from first and second floor panels 12 and 14. In one aspect, the joint between panels 12 and 14 can comprise a joint member, generally designated 16.

In one aspect, a portion of joint member 16 can be adapted to extend between upper surfaces and lateral edges of first and second floor panels 12 and 14. That is, a first portion of joint member 16 can be disposed between and fit at least substantially or entirely flush against a portion of lateral sides or edges of adjacent panels and a second portion of joint member 16 (e.g., an upper surface) can extend from and/or be disposed adjacent and fit at least substantially or entirely flush against upper surfaces of each of panels 12 and 14 such that the exterior floor system comprises a substantially uniform upper surface. Moreover, dirt or debris can easily be swept or cleaned from the substantially uniform upper surface of system 10 such that dirt is prevented from becoming trapped by joint member 16 and/or clogged within one or more openings or holes 28 disposed in joint member. In one aspect, joint member 16 can comprise at least partially or entirely a flexible material. In one aspect, joint member 16 can be rollable such that it can be provided in a roll. Joint member can in one aspect comprise at least partially or entirely a plastic material or a wood plastic composite material that can be adapted to bend or flex along between first and second floor panels 12 and 14. This can be advantageous as portions of the underlying surface may not be substantially flat. Joint member 16 can also comprise at least partially or entirely a stiff material. In one aspect, joint member 16 can for example be a metal material, such as aluminum (Al) or any stamped or rolled metal, plastic or composite material or any other suitable material adapted to withstand exterior environmental conditions. Joint member 16 can include an extruded material or metal (e.g., extruded Al), an anodized material or metal (e.g., anodized Al), and/or a plated material or metal. Whether joint member 16 is a stiff or flexible material, joint member 16 can in one aspect be cut to any desired length or lengths suitable, for example, for a number of different lengths or the entire length of the decking below. The length of joint member 16 is therefore not limited to being the length of the floor panels described below.

First and second floor panels 12 and 14 can comprise any size, shape, dimension, color, surface design, and/or finish (e.g., stain or abrasion resistant surface finishes including aluminum oxide $Al_2O_3$ finishes). In one aspect first and second floor panels 12 and 14 can comprise substantially rectangular shaped floor planks having a surface design that emulates wood and/or wood grain. In other aspects, first and second floor panels 12 and 14 can comprise substantially square shaped floor planks having a surface design that emulates stone, tile, or brick. First and second floor panels 12 and 14 can comprise shapes having more or less than four sides, such as circular, triangular, pentagonal, hexagonal, or octagonal shapes, or any other suitable regular or irregularly shaped panel, as desired. Any combination of shape, surface design, and/or finish is contemplated herein. First and second floor panels 12 and 14 can comprise any width and/or length, such as panels having at least one side measuring approximately 2 centimeters (cm) or more, approximately 10 cm or more, approximately 20 cm or more, approximately 1 foot (ft.) or more, or more than 1 ft. in length and/or width. Typical thicknesses of floor panels 12 and 14 can be from approximately 4-15 mm, typically approximately 6, 8, 10 or 12 mm. Typical widths of floor panels 12 and 14 can also be between approximately 3 and 12 inches, preferably, approximately 3, 5, 8, or 12 inches. Typical lengths of floor panels 12 and 14 can be between approximately 2 and 20 feet, preferably 4, 8, 12, and 16 feet.

In one aspect, first and second floor panels 12 and 14 can comprise a single layer structure consisting entirely of any substantially weather and water-resistant, preferably water impervious or water-proof material, a plastic material, or a wood plastic composite material suitable for exterior use. In other aspects, first and second floor panels 12 and 14 can comprise a multi-layered structure, as indicated by the broken lines, where each layer consists of the same material and/or different materials. Each entire first and second floor panel 12 and 14, and/or portions of first and second floor panels 12 and 14 can comprise a weatherproof plastic or composite material capable of withstanding exterior environmental conditions such as, for example, PVC or a wood plastic composite material. In one aspect, first and second floor panels 12 and 14 can comprise a multi-layered structure where the panels 12, 14 can include a base layer and a surface layer. The base layer can comprise the same or a different material(s) than the surface layer. In one aspect, the base layer can comprise a plastic material, a composite material, or a cellulosic material, such as wood particles, impregnated with a resin, such as a thermoplastic material. The surface layer can comprise a layer of weatherproof decorative plastic, composite, or thermosetting material that can optionally be glued on top of the base layer, where used. Any single or multi-layered structure comprising any material(s) is contemplated herein.

Still referring to FIG. 1, each of first and second floor panels 12 and 14 can comprise opposing edges disposed on outermost opposing lateral sides where each lateral edge is provided with at least one groove, generally designated 18. In one aspect, the at least one groove 18 can be longitudinally disposed along the length of opposing long edges of first and second floor panels 12 and 14, for example, where the panels are rectangular in shape. Groove 18 can be provided in first and second floor panels 12 and 14 via mechanical processing techniques including machining, milling, drilling, or any other suitable mechanical removal process. Groove 18 can comprise a void adapted to engage a projection portion of joint member 16, where groove 18 can be defined by at least an upper groove definition 20 and a lower groove definition 22. Lower groove definition 22 can extend further in length than upper groove definition 20 to provide for improved and more efficient locking and/or rotatable click assembly with a locking member, such as a tongue or projection of joint member 16. In one aspect, groove 18 can extend the full length of the long edges along each of the first and second floor panels 12 and 14, or groove 18 can be intermittently spaced along portions of the long edges along the length of panels 12 and 14.

Although the subject matter has been described and shown as being assembled through a relative rotational movement of panels 12 and 14 and joint member 16, the subject matter is not so limited. For example, it is considered within the scope of the invention to design joint member 16 to permit assembly via solely vertical movement, solely horizontal movement or any combination of horizontal, vertical and rotational movement. Moreover, the joint between either of the panels 12 and 14 and the joint member 16 may be designed to include "play" and/or "pretension" where, after assembly, the panels 12 and 14 may be displaced relative to each other along the length of the joint.

Groove 18 can be configured to engage with a correspondingly shaped portion of locking member or tongue of joint member 16. As described further below with respect to FIGS. 3A and 3B, joint member 16 can comprise a body portion 24 disposed between one or more locking portions or projections, such as for example one or more tongue portions 26. In one aspect, body portion 24 can be centrally disposed with respect to two tongue portions 26. Each tongue portion 26 provided on joint member 16 can be adapted to lock with, such as by matingly engaging, grooves 18 disposed in adjacent first and second floor panels 12 and 14, respectively. Locking engagement between joint member 16 and grooves 18 of adjacent panels can be achieved for example by frictional engagement between protrusions of joint member 16 and correspondingly shaped recesses of groove 18. In one aspect, tongue portions 26 of joint member 16 can click or snap into respective grooves 18 of floor panels 12 and 14.

Notably, joint member 16 does not have to be a watertight joint and can instead allow water or other liquids to pass between floor panels 12 and 14 and is, therefore, unexpected in light of conventional floor panel designs consisting of substantially tight fitting and watertight joints. Joint member 16 can comprise one or more slots, openings, or holes 28 disposed along its length. Holes 28 can be formed in joint member 16 during a molding process or holes can be mechanically formed via machining, drilling, punching, stamping, or any other mechanical process for removing material from a structure. Holes 28 can be disposed within body portion 24 and can extend from an upper surface (50, FIG. 3A) of joint member 16 through body portion 24 and into a collection space or area (56, FIG. 3A) disposed between first and second floor panels 12 and 14.

Upper surface 50 can define at least one or a plurality of holes 28 such that water can be channeled directly from adjacent panels downwardly along the continuous upper surface 50 disposed between panels. Holes 28 can be adapted to effectively allow a liquid, such as rain or water, to drain between first and second floor panels 12 and 14 from an upper surface of the floor covering and prevent accumulation of liquid on the surface of the panels. Notably, joint member 16 can join or connect edges of adjacent first and second floor panels 12 and 14 while at the same time allowing liquid to pass between the respective panels. Joint member 16 can be provided in a gap between first and second floor panels 12 and 14, thereby spacing the adjacent floor panels apart. Joint member 16 can comprise a plastic spacer for substantially filling the gap between first and second floor panels 12 and 14 such that upper surfaces of each of the floor panels 12, 14 and joint member 16 are adjacent. System 10 can advantageously provide a jointed floor covering system having a substantially continuous and uniform upper surface and not, therefore, a substantially fragmented, divided, or uneven surface because of the gaps or spaces disposed between adjacent floor panels.

Figure 2:
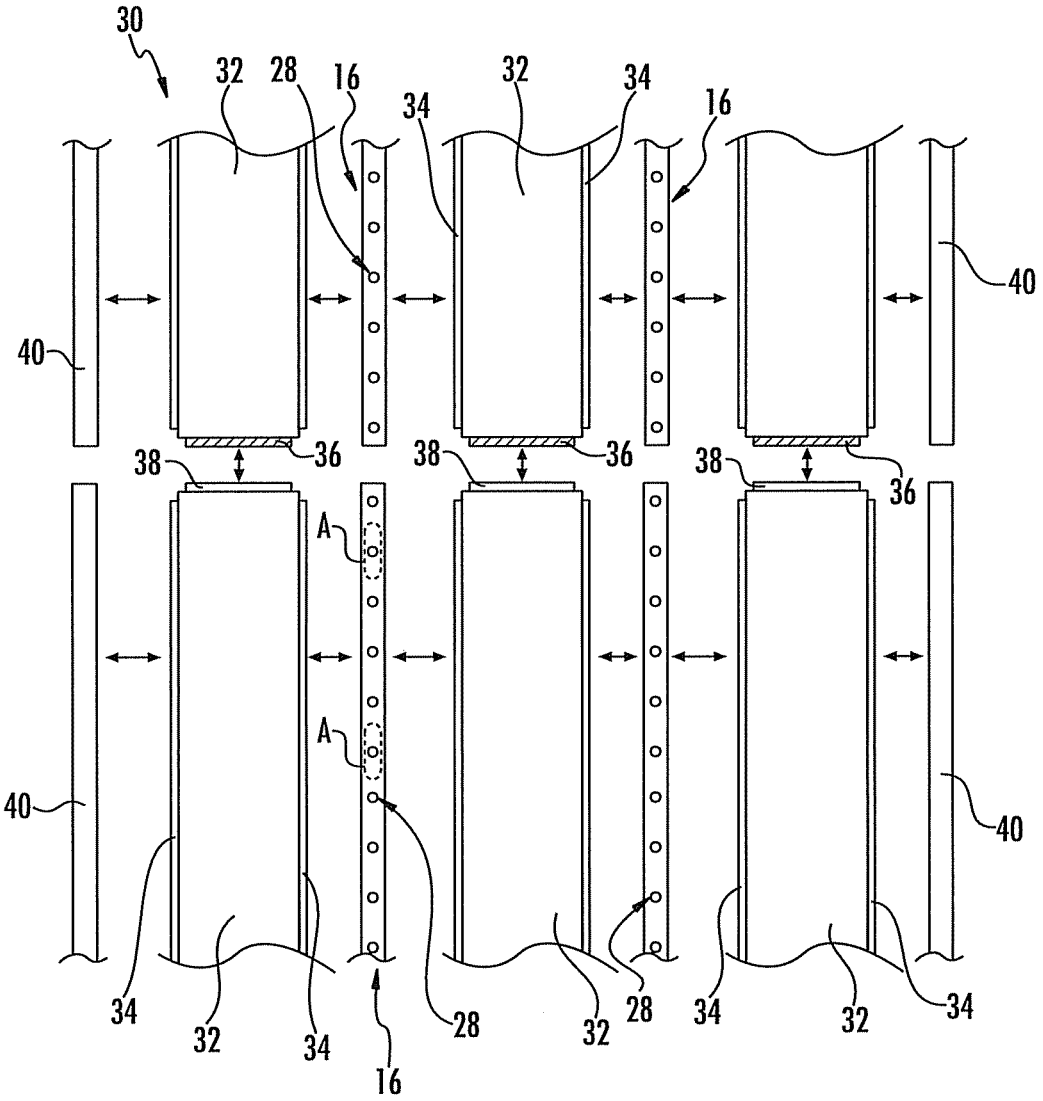
FIG. 2 is a top view of the joint device and system of floor panels for an exterior floor covering according to the disclosure herein.

FIG. 2 is a top view of a system, generally designated 30, for providing a floor covering comprising a plurality of adjacent floor planks or floor panels 32 with a plurality of joint members 16 disposed between each of the adjacent panels 32. Floor panels 32 can be similar in form and function to previously described first and second floor panels 12 and 14. For illustration purposes, rectangular shaped panels 32 are shown, however, panels 32 can comprise any suitable shape such as substantially square, circular, triangular, hexagonal, etc. Notably, floor panels 32 and joint members 16 can be adapted to assemble together and cover an existing exterior floor structure or surface such as unsightly or aged surfaces of an outdoor patio or outdoor deck. Floor panels 32 can be assembled by rotating or tapping tongue portion (26, FIG. 3A) of joint member 16 into grooves 34 of adjacent floor panels 32. Floor panels 32 preferably comprise non-structural (i.e., structural sub-flooring required) components such that when joined via joint member 16, panels 32 and joint member 16 can collectively establish a floor covering similar to an exterior area rug configured for application or installation directly over an existing exterior surface. In one aspect, panels 32 can lock together without requiring glue and without being glued to the surface of the underlying exterior floor structure or surface. Thus, system 30 can comprise a mobile and re-usable floor covering that can quickly and easily become assembled and disassembled without requiring application or removal of glued components.

Each of the plurality of adjacent floor panels 32 can comprise grooves 34 disposed along at least a portion of at least first and second lateral sides along opposing lateral edges. As illustrated, grooves 34 can be disposed along portions of first and second long sides or long edges of panels 32 alone; however, grooves 34 could also be disposed along portions of third and fourth opposing short edges (e.g., short sides or edges) as well, either alone or in combination with grooved long edges. System 30 can comprise at least one joint member 16 disposed between inwardly facing grooves 34 of adjacent long edges of adjacent panels 32. At least one other joint member 16 could optionally be disposed between grooves of adjacent short edges of adjacent panels 32, where short edges comprise grooves. That is, each floor panel 32 can be surrounded and configured to engage one, two, or more than two joint members 16 on one, two, or more than two edges. Notably, joint member 16 can be configured to engage adjacent grooves 34 of adjacent panels and lock the panels together.

As FIG. 2 illustrates, at least one short side of a first panel of the plurality of panels 32 can comprise a tongue 36 configured to engage or lock with an adjacent and outwardly facing groove 38 disposed on an adjacent short side of a second panel of the plurality of panels 32. As such, short sides of adjacent panels 32 can directly lock or join to each other via locking or clicking together on short sides. Adjacent panels 32 can be directly locked or joined via engagement between the adjacent tongue 36 and groove 38 portions. Thus, in one embodiment, a first panel of the plurality of panels 32 can connect directly to at least one other panel along a first edge and directly to at least one joint member 16 along a second edge. For panels disposed in the center or middlemost region of system 30, a first panel of the plurality of panels 32 can connect directly to at least one other panel and at least two joint members 16. In further embodiments, as discussed above, short sides can optionally also connect to joint member 16 such that it is possible for at least one panel of the plurality of panels 32 to be connected on all sides directly to joint members 16. The plurality of panels 32 and joint members 16 can be installed together by rotating or tapping respective components in any direction indicated by the arrows.

System 30 can further comprise perimeter transition or end components 40 disposed about the perimeter of the outermost floor panels 32. In one aspect, end components 40 can comprise projections or tongues adapted to engage grooves 34 and 38 along respective long and short edges to produce or define the finished floor covering such that grooves disposed along the perimeter are covered. End components 40 could also comprise grooves (not shown) adapted to engage an intervening joint member 16 such that water can drain close to the perimeter of the floor covering system.

Still referring to FIG. 2, system 30 can comprise intermediate joint members 16 disposed between and substantially parallel to long sides or edges of adjacent, rectangular shaped panels 32. Joint members 16 can longitudinally align and/or abut end-to-end along the length of system 30 forming long channels for effectively draining liquid between panels 32 along the length of system 30. As noted above, joint member 16 can comprise holes 28 spaced at intervals along the length of joint member 16. Holes 28 can facilitate effective draining of liquid, such as water from surfaces of adjacent panels 32. Joint member 16 and adjacent panels 32 can each comprise weatherproof materials suitable for use in outdoor applications. In one aspect, joint member 16 can comprise a resin material with an optional surfactant added thereto. A surfactant can advantageously prevent dirt or other debris from collecting inside holes 28. Joint member 16 can further include anti-microbial properties and be optionally treated with an anti-microbial agent to prevent or slow the growth of mold or mildew. For example, anti-microbial agents can comprise any suitable material such as metal ions, (e.g., silver (Ag) ions) which can be applied either during or after manufacture of joint member. In one aspect, the metal ions can be applied via spraying, dipping, and/or curtain coating joint member 16. In further aspects, metal ions can be disposed within the weatherproof material or resin during manufacture.

Holes 28 can comprise an opening of any size, shape, orientation, and/or configuration. For example and in one aspect, holes 28 can comprise elongated channels or slotted openings or areas disposed along the length of joint member 16, as designated by the broken lines A. Slots can allow a larger quantity of water to collect and drain between panels 32 and/or allow collected water to drain about an attachment member (e.g., 59, FIG. 3B) such that system 30 can be permanently or temporarily secured and attached to the underlying floor, while still being able to effectively drain water between panels.

In one aspect, system 30 can be assembled over existing outdoor surfaces to provide a weatherproof floor covering that is aesthetically appealing, easy to install, and durable. System 30 can comprise a floor covering adapted to easily cover at least a portion of an existing wooden deck such that the deck can be effectively covered without having to wash, sand, stain and/or re-finish the surface of the wooden deck. When covering an existing structure such as a wooden deck with the floor covering system 30, the existing deck should be structurally sound and relatively flat. Any rotted or warped boards should first be replaced.

Figure 3A:
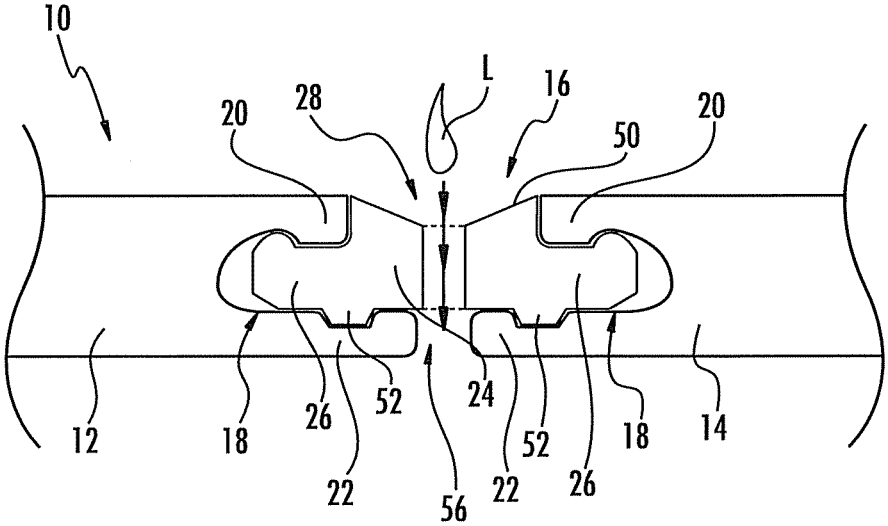
FIGS. 3A and 3B are cross-sectional views of the joint device and system of floor panels for an exterior floor covering according to the disclosure herein.
Figure 3B:
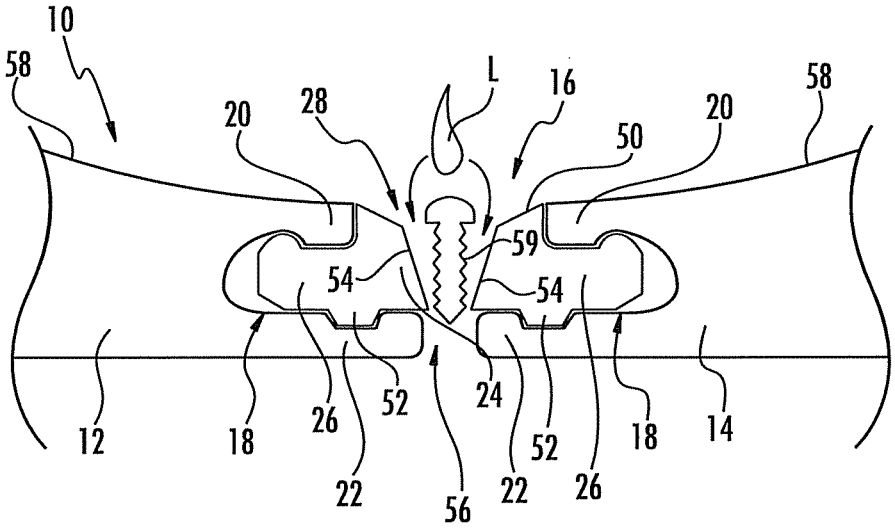

FIGS. 3A and 3B illustrate various cross-sectional views of system 10 described in FIG. 1. System 10 can comprise a floor covering or joint system for covering outdoor surfaces or existing outdoor floor structures. As described above, system 10 comprises at least a first panel 12, second panel 14, and joint member 16 disposed therebetween. First and second panels 12 and 14 can comprise "female" or grooved profiles or edges. Joint member 16 can comprise two "male" or tongued profiles or edges. Joint member 16 can also be adapted to join panels having two "male" profiles (see e.g., FIG. 6A) and/or a first panel having a female profile and a second panel having a male profile (see e.g., FIG. 6B). Systems described herein can also comprise a plurality of panels and joint members as shown and described in FIG. 2. Notably, each of first and second floor panels 12 and 14, respectively and joint member 16 can comprise a weatherproof material suitable for outdoor use. As FIG. 3A illustrates, first and second floor panels 12 and 14 can comprise a substantially flat upper surface. Alternatively, and as illustrated in FIG. 3B, at least a portion of first and second floor panels 12 and 14 can comprise a non-flat upper surface 58. At least a portion of the panels can comprise an upper surface 58 that is inwardly sloped and/or at least partially concave. Non-flat upper surface 58 can advantageously promote water flow into joint member 16 or system 10 for flowing between adjacent panels.

In one aspect joint member 16 can comprise a weatherproof spacer for providing a gap between first panel 12 and second panel 14 allowing liquid L to drain therebetween. Liquid L can effectively pass through the channel, slot, any size or shape of opening, such as hole 28 within joint member 16. Joint member 16 can comprise an upper surface 50 that is adjacent and substantially an aligned continuous extension of the upper surfaces of adjacent panels. Notably, the continuous upper surfaces of panels 12, 14 and joint member 16 can provide a substantially uniform surface. Upper surface 50 can be configured to align with the upper surface of first floor panel 12 and/or second floor panel 14 for providing the floor covering with a continuous upper surface between floor panels and over the gap between floor panels.

Upper surface 50 can comprise a slightly angled, inclined or sloped surface that can slope inwardly towards a center of joint member 16 and downwardly towards hole 28 such that hole 28 can more effectively receive and drain or discharge liquid L. As FIG. 3A illustrates, hole 28 can comprise substantially straight and/or substantially vertical walls. Alternatively, as FIG. 3B illustrates, hole 28 can comprise substantially tapered inner walls 54 which taper inwardly and/or outwardly. For illustration purposes, tapered inner walls 54 are shown as inwardly tapered such that hole 28 is wider at the top allowing for more efficient collection and draining of liquid L. Upper surface 50 can comprise a sloped surface that continuously slopes downwardly from upper surfaces of adjacent floor panels and can be shallow enough that a broom or cleaning implement can easily brush dirt and debris away from the surface such that it does not become trapped over joint member 16 and/or within holes 28. Upper surface 50 can guide liquid L towards hole 28 and drain liquid L between panels. Hole 28 can extend in length from upper surface 50 of joint member 16 to a collection space or area 56 disposed below joint member 16. Collection area 56, for example and without limitation, can comprise a void or gap disposed between first and second panels 12 and 14. Collection area 56 can be disposed between lower groove definitions 22 of adjacent first and second panels 12 and 14, respectively. Liquid L can be channeled into collection area 56 where it can collect and either subsequently drain between boards, cracks, or pores of the underlying deck or patio structure, be cleaned or blown out, or from where it can evaporate.

Hole 28 can comprise a width or diameter that is approximately equal to or less than a width or diameter of the space or gap between lower groove definitions 22 of adjacent panels 12 and 14. Notably, the gap between opposing upper groove definitions 20 of adjacent panels 12 and 14 can be longer in width or wider than the gap between opposing lower groove definitions 22 of adjacent panels 12 and 14 such that larger portions of liquid can be funneled into collection area 56. That is, hole 28 can extend between upper surface 50 of joint member 16 and collection area 56 such that upper surface 50 is wider than the spaced defined by collection area 56 (e.g., gap between adjacent lower groove definitions 22) such that more liquid can be funneled into collection area 56 via the longer or wider upper surface 50. As FIG. 3B illustrates, joint 16 can comprise tapered inner walls 54 which are also configured to funnel water into collection area 56.

FIG. 3B illustrates a novel embodiment of system 10, in which system can be optionally attached and/or secured in place as a floor covering. Notably, an attachment member 59 can be inserted within a portion of hole 28 for allowing the system 10 to be temporarily or permanently secured to an underlying structure when desired (e.g., during inclement weather, while sweeping, high-power blowing, or power-washing panels). Liquid L can still advantageously drain into hole 28 and out of the underlying structure (e.g., 60, FIG. 4) by flowing about attachment member 59. For example, where hole 28 comprises an elongated opening or slot (e.g., A, FIG. 2), attachment member 59 can be secured within a small portion of the slot such that the remaining portion of the slot can open into collection area 56. This can allow liquid L to flow along tapered inner walls 56, around attachment member 59, and then out from portions or areas around attachment member 59 which discharge liquid L into collection area 56.

As described above, joint member 16 can be configured to lock and/or click into portions of adjacent floor panels 12 and 14. In one aspect, the one or more tongue portions 26 of joint member 16 can comprise a protruding lower web portion 52 configured to engage a correspondingly shaped recess portion of groove 18. In one aspect, joint member 16 can be installed at an angle and rotated to click and/or otherwise lock into groove 18. In further aspects, joint member 16 can be tapped into groove 18. Adjacent first and second floor panels 12 and 14 and joint member 16 can be unlocked and locked (e.g., re-joined) together multiple times such that system 10 can comprise a mobile and reusable floor covering. Joint member 16 can optionally comprise a decorative surface or surface design such that joint member 16 can also emulate the appearance of wood, wood grain, stone, tile, or brick surfaces. Joint 16 and panels 12 and 14 can comprise the same or different materials. Preferably, joint member 16 and panels 12 and 14 can comprise a weatherproof plastic or wood plastic composite material. Adjacent first and second floor panels 12 and 14 can advantageously lock to joint member 16 comprising holes 28, thereby providing an aesthetically pleasing and easy to install outdoor floor covering capable of discharging liquid and water from the surface of the floor covering. This floor covering can therefore render refinishing aged exterior surfaces (e.g., washing, sanding, and re-staining an aged wooden deck) obsolete.

It is also within the scope of the subject matter herein to manufacture the joint member 16 out of a solid, yet flexible and/or bendable material as noted previously, such as a natural or synthetic rubber. In this embodiment, the joint member 16 can flex or bend to allow for situations where the subsurface is not completely flat.

Figure 4:
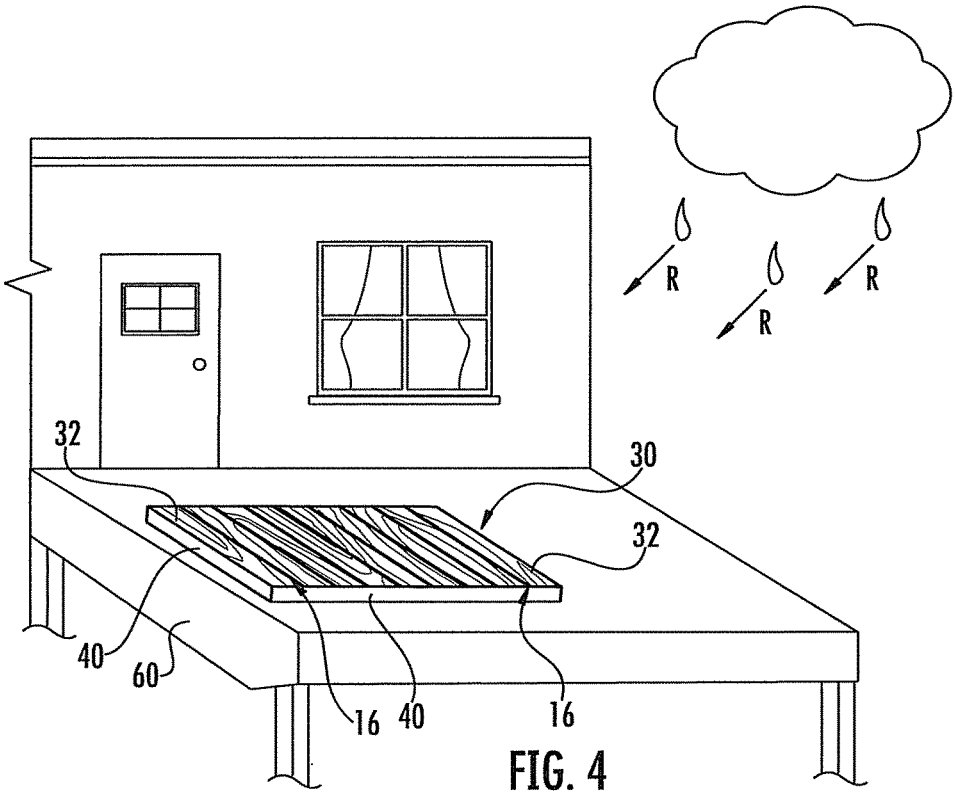
FIGS. 4 and 5 are views of exterior floor coverings according to the disclosure herein.
Figure 5:
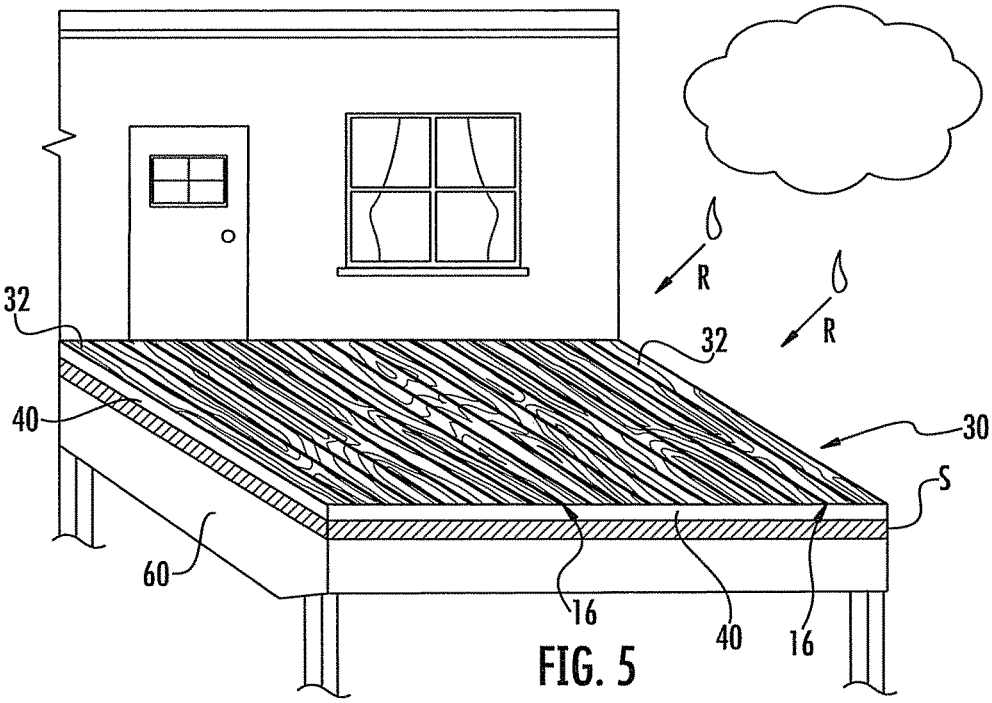

FIGS. 4 and 5 illustrate system 30 comprising a floor covering that is disposed over an existing outdoor structure or surface such as an existing and aged wooden deck 60. System 30 can comprise a floor covering adapted to be installed over outdoor surfaces such as deck 60 to relieve homeowners from the expense and time it takes to re-finish aged decks and by providing an attractive, durable, and easy to install covering over the aged structure. Notably, system 30 can be used outdoors and comprise a weatherproof material to withstand rain R and any other outdoor environmental element and weather condition. Rain R or other liquid can be effectively drained and pass between panels 32 via passing into holes (28, FIGS. 3A/3B) of joint member 16. The rain R can then pass out of cracks, gaps, or pores of the underlying structure, for example, rain R can ultimately be discharged from between boards of the underlying deck structure 60. As FIG. 4 illustrates, system 30 can comprise a floor covering provided and installed over a portion of the surface of deck 60, such as what could be provided with an exterior area rug. As FIG. 5 illustrates, system 30 can comprise a floor covering that can be installed over the entire surface of deck 60 to provide an attractive deck covering as an alternative to washing, sanding, and staining deck 60. It is also noted that having a joint member staggering from the deck 60 short ends will support the evenness between the short side joints.

FIGS. 4 and 5 illustrate a floor covering comprised of system 30. The floor covering can comprise a plurality of floor panels 32 arranged in parallel rows over a portion of the surface of outdoor deck 60. The floor covering can also comprise a plurality of joint members 16 disposed between the parallel rows of the floor panels 32. Joint members 16 can be arranged end-to-end between the parallel rows of floor panels 32 and can be adapted to pass a liquid (e.g., rain R) between the parallel rows of floor panels 32. Upper surfaces of each of the plurality of floor panels can connect directly to angled upper surfaces 50 (FIGS. 3A/3B) of each of the plurality of joint members 16 such that the plurality of floor panels 32 and joint members 16 form a continuous upper surface of the floor covering. Liquid can be efficiently drained from the upper surface of the floor covering via the network of spaced apart rows of joint members 16.

As FIG. 5 further illustrates, in order to provide an increased opportunity for any collected water or moisture to evaporate, an optional undersurface spacer S can be provided between a portion of floor panels 32 and the surface of the outdoor deck 60. As spacer S is optional, it may also be included in embodiment shown in FIG. 4, and/or may not be included in the embodiment shown in FIG. 5. Spacer S can comprise an entangled net product for example, produced from an extruded polymer matrix of tangled monofilaments, which are heat-welded at the junctions. A preferred spacer S can comprise the QUIET QURL® RF product (with the fiberglass mat removed) available from Keene Building Products of Mayfield Heights, Ohio. Spacer S can also include a ventilated molding material, for example as shown and described in U.S. Pat. No. 7,793,483, which is commonly owned and assigned, and the entire contents of U.S. Pat. No. 7,793,483 are incorporated by reference herein.

Figure 6A:
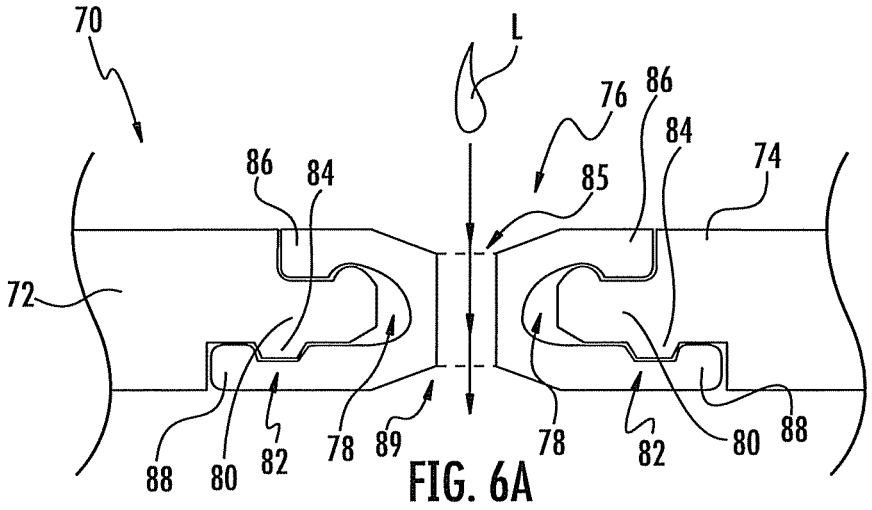
FIGS. 6A and 6B are cross-sectional views of further embodiments of a joint device and system of floor panels according to the disclosure herein.
Figure 6B:
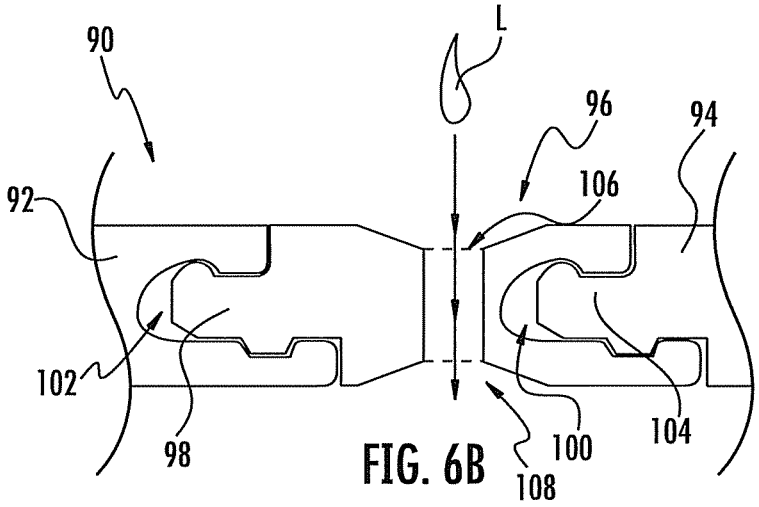

FIGS. 6A and 6B illustrate further embodiments of cross-sectional views of a joint device and system, generally designated 70 and 90, respectively. Systems 70 and 90 can comprise floor covering or joint systems for covering outdoor surfaces or existing outdoor floor structures. Systems 70 and 90 can be similar in form and function to previously described system 10, but systems 70 and 90 can be used for joining two panels having male edges or profiles (e.g., tongued profiles) or a first panel having a female profile and a second panel having a male profile.

Referring to FIG. 6A, system 70 can comprise at least a first panel 72, a second panel 74, and a joint member 76 disposed therebetween. Joint member 76 can be similar to previously described joint member 16, however, instead of one or more tongue portions for joining panels having female profiles (e.g., panels 12 and 14, FIG. 3A), joint member 76 can comprise one or more grooved portions 78 for joining adjacent panels having male profiles. Each of first and second floor panels 72 and 74, respectively and joint member 76 can comprise a weatherproof material suitable for outdoor use. As FIG. 6A illustrates, first and second floor panels 72 and 74 can comprise an edge having a tongue 80 thereby constituting a male profile or male edge profile. At least a portion of tongue 80 can be configured to join and/or engage a portion of joint member 76. For example, tongue 80 of first panel 72 can be configured to engage a first groove portion 78 of joint member 76 and tongue 80 of second panel 74 can be configured to engage an opposing groove portion 78 of joint member 76. Each groove portion 78 can comprise one or more recesses 82 adapted to receive one or more correspondingly shaped web portions 84 of tongues 80. Joint 76 can comprise a body having two female edges or female profiles (e.g., grooves 80) configured to join panels with correspondingly shaped panels comprising male edges. Joint member 76 can comprise at least one opening 85 for passing a liquid L between first and second panels 72 and 74. Opening 85 can comprise a circular hole, a channel, a slot, or any opening adapted to drain water between panels.

Joint member 76 can comprise upper groove definitions 86 and lower groove definitions 88 disposed about each groove 78. Lower groove definitions 88 can optionally extend further in length than upper groove definitions 88 for extending about and receiving tongue portions 80. An upper surface of joint member 76 can extend from the upper surfaces of panels 72 and 74, and can incline or slope inwardly towards opening 85 to facilitate improved draining of liquid L. Liquid L can collect and/or drain from a collection area 89 disposed between panels 72 and 74. Collection area 89, for example and without limitation, can comprise a void or gap disposed between first and second panels 72 and 74. Collection area 89 can be disposed between tongue portions 80 of adjacent first and second panels 72 and 74, respectively. Liquid L can be channeled into collection area 89 where it can collect and either subsequently drain between boards, cracks, or pores of the underlying deck or patio structure, be cleaned or blown out, or from where it can evaporate. Joint member 76 can comprise a bottom surface having a first portion that is co-planar with bottom surfaces of panels 72 and 74 and a second portion that is non-planar and/or disposed above the bottom surfaces of adjacent panels 72 and 74 thereby defining collection area 89.

Referring to FIG. 6B, system 90 can comprise at least a first panel 92, a second panel 94, and a joint member 96 disposed therebetween. Joint member 96 can be similar to previously described joint member 16, however, joint member 96 can be adapted to join panels having both male and female profiles. That is, joint member 96 can comprise a first edge or profile comprising a female profile and a second edge comprising a male profile. For example, joint member 96 can comprise a tongue portion 98 and a groove portion 100. At least portion of a tongue portion 98 of joint member 96 can be configured to engage at least a portion of one or more grooves 102 disposed along an edge of first panel 92. In addition, at least a portion of groove portion 100 of joint member 96 can be configured to engage a portion of a tongue 104 disposed along an edge of second panel 94. Thus, customized floors having either all female edges or profiles, all male profiles, or combinations thereof can be joined and assembled using joint devices and systems described herein.

Notably, each of first and second floor panels 92 and 94, respectively and joint member 96 can comprise a weatherproof material suitable for outdoor use. Joint member 96 can comprise at least one opening 106 for passing a liquid L between first and second panels 92 and 94. Opening 106 can comprise a circular hole, a channel, a slot, or any opening adapted to drain water between panels. Liquid L can collect and/or drain from a collection area 108 disposed between panels 92 and 94. Collection area 108 can be disposed between tongue and groove portions 98 and 100, respectively, of adjacent first and second panels 92 and 94. Liquid L can be channeled into collection area 108 where it can collect and either subsequently drain between boards, cracks, or pores of the underlying deck or patio structure, be cleaned or blown out, or from where it can evaporate. Joint member 96 can comprise a bottom surface where at least a portion is co-planar with bottom surfaces of panels 92 and 94.

Embodiments of the present disclosure shown in the drawings and described above are exemplary of numerous embodiments that can be made within the scope of the appended claims. It is contemplated that the novel joint devices, systems, and methods described herein can comprise numerous configurations other than those specifically disclosed.

What is claimed is:

1. A joint system comprising:

at least a first floor panel comprising a first locking profile;

at least a second floor panel comprising a second locking profile; and a joint member disposed between the first floor panel and the second floor panel;

wherein the joint member is adapted to pass a liquid between the first floor panel and the second floor panel, and wherein each of the first floor panel, the second floor panel, and the joint member comprise a weatherproof material;

wherein the joint member comprises a strip which, at both edges, has opposing locking profiles with one or more vertical and horizontal locking surfaces adapted to co-operate behind portions of the first and second locking profiles of the first floor panel and the second floor panel to secure the joint member thereto; and wherein the opposing locking profiles of the joint member do not intersect a vertical midplane between the first and second floor panels; and wherein an upper surface of the joint member is at a same level as and/or lower than at least a portion of an upper surface of the first floor panel and/or the second floor panel.

2. The system of claim 1, wherein the first floor panel and the second floor panel are disposed over a substantially planar outdoor surface.

3. The system according to claim 1, wherein the first and second panels comprise the same weatherproof material as the joint member.

4. The system according to claim 1, wherein the first and second panels comprise a first weatherproof material and wherein the joint member comprises a second weatherproof material that is different than the first weatherproof material.

5. The system according to claim 1, wherein the joint member comprises at least one opening adapted to drain liquid from the surface of the floor covering.

6. The system according to claim 5, wherein the opening comprises a channel.

7. The system according to claim 5, wherein the opening comprises a slot.

8. The system according to claim 5, wherein the opening comprises a tapered inner wall.

9. The system according to claim 5, wherein the at least a portion of the opening is adapted to receive an attachment member.

10. The system according to claim 1, further comprising a plurality of floor panels arranged in parallel rows.

11. The system according to claim 10, further comprising a plurality of joint members disposed between the parallel rows of floor panels.

12. The system according to claim 1, wherein the joint member comprises an angled upper surface that connects to an upper surface of each of the first and second floor panels.

13. The system according to claim 12, wherein the angled upper surface slopes downwardly towards at least one opening.

14. The system according to claim 1, wherein the joint member comprises first and second tongue portions for connecting to first and second grooves disposed in edges of the first and second floor panels.

15. The system according to claim 1, further comprising a spacer disposed between the first and second floor panels and the outdoor surface.

16. The system according to claim 1, wherein the joint member comprises a metal.

17. The system according to claim 1, wherein the joint member comprises silver (Ag) ions added either during or after manufacture.

18. The system according to claim 1, wherein the joint member is anti-microbial.

19. The system according to claim 1, wherein the joint member comprises a surfactant.

20. The system according to claim 1, wherein the joint member comprises at least one groove.

21. The system according to claim 1, wherein the first floor panel and the second floor panel comprise male profiles.

22. The system according to claim 1, wherein the first floor panel and the second floor panel comprise female locking profiles.

23. The system according to claim 1, wherein the first floor panel comprises a male profile and the second floor panel comprises a female profile.

* * * * *